US010779083B2

(12) United States Patent
Stead et al.

(10) Patent No.: US 10,779,083 B2
(45) Date of Patent: Sep. 15, 2020

(54) SOUNDBAR HAVING SINGLE INTERCHANGEABLE MOUNTING SURFACE AND MULTI-DIRECTIONAL AUDIO OUTPUT

(71) Applicant: D&M Holdings, Inc., Kanagawa (JP)

(72) Inventors: Brendon Stead, Carlsbad, CA (US); Achim Schulz, Nettetal (DE)

(73) Assignee: D&M Holdings, Inc., Kanagawa (JP)

( * ) Notice: Subject to any disclaimer, the term of this patent is extended or adjusted under 35 U.S.C. 154(b) by 0 days.

(21) Appl. No.: 16/322,184

(22) PCT Filed: Aug. 1, 2017

(86) PCT No.: PCT/US2017/044873

§ 371 (c)(1),
(2) Date: Jan. 31, 2019

(87) PCT Pub. No.: WO2018/026799

PCT Pub. Date: Feb. 8, 2018

(65) Prior Publication Data

US 2019/0191248 A1 Jun. 20, 2019

Related U.S. Application Data

(60) Provisional application No. 62/369,427, filed on Aug. 1, 2016.

(51) Int. Cl.
*H04R 5/02* (2006.01)
*H04R 1/40* (2006.01)
(Continued)

(52) U.S. Cl.
CPC ..... *H04R 5/02* (2013.01); *H04R 1/025* (2013.01); *H04R 1/403* (2013.01); *H04S 7/305* (2013.01);
(Continued)

(58) Field of Classification Search
CPC ..... H04R 5/02; H04R 1/025; H04R 1/403; H04R 1/02; H04R 29/002; H04S 7/305; H04S 3/008; H04S 2420/01
(Continued)

(56) References Cited

U.S. PATENT DOCUMENTS 7,171,010 B2 1/2007 Martin et al.
8,351,639 B2 * 1/2013 Chang ..... H04R 1/345 181/129
(Continued)

FOREIGN PATENT DOCUMENTS

FR 2962001 12/2011
WO 2016088745 6/2016

OTHER PUBLICATIONS

International Search Report for PCT/US17/44873, dated Oct. 24, 2017.

*Primary Examiner* — Disler Paul
(74) *Attorney, Agent, or Firm* — Peter A. Nieves; Sheehan Phinney Bass & Green PA

(57) ABSTRACT

A sound bar is provided which includes a generally elongate rectangular structure, with one angled output face having a plurality of speakers disposed therein, to thereby provide enhanced audio output. The sound bar is beneficially provided with a single mounting surface configured and arranged such that the sound bar can be mounted on both a table/shelf (horizontal orientation) and a wall (vertical orientation) via the single mounting surface by rotating the sound bar 180°, wherein the audio output in both mounting orientations is a multi-directional 3D audio output that travels to and bounces off both the walls and the ceiling of a room in which the sound bar is located.

18 Claims, 6 Drawing Sheets

(51) Int. Cl.

| | |
|---|---|
| ***H04R 1/02*** | (2006.01) |
| ***H04S 7/00*** | (2006.01) |
| *H04S 3/00* | (2006.01) |
| *H04R 29/00* | (2006.01) |

(52) U.S. Cl.
CPC ..... *H04R 1/02* (2013.01); *H04R 29/002* (2013.01); *H04S 3/008* (2013.01); *H04S 2420/01* (2013.01)

(58) Field of Classification Search
USPC ..... 381/303, 305
See application file for complete search history.

(56) References Cited

U.S. PATENT DOCUMENTS

| | | | | |
|---|---|---|---|---|
| 9,049,518 | B2 * | 6/2015 | Freeman | H04S 3/008 |
| 9,213,762 | B1 * | 12/2015 | Erven | H04B 1/20 |
| 10,425,723 | B2 * | 9/2019 | Smithers | H04R 1/345 |
| 2012/0051567 | A1 * | 3/2012 | Castor-Perry | H04R 29/002 381/304 |
| 2012/0263335 | A1 * | 10/2012 | Breen | H04R 1/403 381/387 |
| 2013/0121515 | A1 * | 5/2013 | Hooley | H04R 1/403 381/307 |
| 2013/0230174 | A1 * | 9/2013 | Oliveras | H04R 5/04 381/17 |
| 2014/0126753 | A1 | 5/2014 | Takumai et al. | |
| 2015/0356975 | A1 | 12/2015 | Seo | |
| 2016/0330562 | A1 * | 11/2016 | Crockett | H04S 7/301 |
| 2017/0070837 | A1 * | 3/2017 | De Poortere | H04S 7/302 |

* cited by examiner

SOUNDBAR HAVING SINGLE INTERCHANGEABLE MOUNTING SURFACE AND MULTI-DIRECTIONAL AUDIO OUTPUT

CROSS-REFERENCE TO RELATED APPLICATIONS

This application is the National Stage of International Application No. PCT/US17/44873, filed Aug. 1, 2017 and entitled SOUNDBAR HAVING SINGLE INTERCHANGEABLE MOUNTING SURFACE AND MULTI-DIRECTIONAL AUDIO OUTPUT, which claims the benefit of U.S. Provisional Application No. 62/369,427, filed Aug. 1, 2016 and entitled SOUNDBAR HAVING SINGLE INTERCHANGEABLE MOUNTING SURFACE AND MULTI-DIRECTIONAL AUDIO OUTPUT. The contents of these prior applications are incorporated by reference herein in their entirety.

FIELD OF THE INVENTION

The present invention generally relates to a sound bar, and more particularly to a sound bar that can be interchanged between a horizontal (e.g., table/shelf) mount and a vertical (e.g., wall) mount and which directs a 3D audio output at an angle relative to the sound bar such that the audio output is directed toward both the walls and the ceiling of a room.

BACKGROUND

Continuous advancements in technology have led to the development of TVs that are increasingly thin and which produce more and more life-like picture quality. However, with such advancements, there are issues surrounding how to provide equally impressive sound. Speakers typically require a significant amount of space to provide quality audio. However, today's flat screen TVs fail to provide adequate space. Typically, with such flat screen TVs, small built-in speakers are placed on the back or bottom of the TV. However, these small speakers directed at the wall or floor are generally lacking from most consumers' perspectives. Thus, there is a need for a sound system separate from such TVs to provide high-quality audio.

One solution is to provide a sound system that involves strategic placement of multiple speakers around the room. While this certainly can provide excellent audio, it is not necessarily aesthetically pleasing, and there is the added challenge of running wires to the speakers as well as the significant expense.

Another solution is the sound bar, which is a simple way to provide high-quality sound without taking up too much space and without becoming too costly. These sound bars are typically long and relatively thin, and can be mounted on the wall (e.g., below a wall mounted flat screen TV) or on a shelf below the TV.

The use of sound bars provides increased volume, range, clarity, and fullness to the audio output. For example, sound bars can advantageously be designed and placed to reflect sound off walls, which can trick a listener into thinking that there are speakers all around. Some sound bars are designed to enhance voice dialogue, which makes voices stand out more than other sounds being output. Sound bars can also be provided with volume leveling, which prevents the volume of commercials from being louder than that of the program being viewed.

Most sound bars house two to five speakers (although some may have more) in a single elongate enclosure. For example, more basic sound bars are typically provided with 2.1 channels, containing two speakers with a separate subwoofer. More complex sound bars may be provided with multi-channels, e.g., up to five or seven audio channels, with discrete sounds for each channel, to provide an enhanced surround sound effect.

FIG. 1 shows a standard front facing sound bar 1 having a generally elongate rectangular structure with a front surface 2, bottom surface 3, back surface 4, and top surface 5. As shown, a plurality of speakers 6 are disposed in the front surface 2. Due to the design and positioning of the speakers 6, this type of sound bar 1 is generally mounted on a table or shelf below a TV with the bottom surface 3 resting on the table or shelf, or it can be wall mounted with the back surface 4 mounted on the wall. When thus mounted, the audio output is directed from the speakers 6 on the front surface 2 in a generally forward direction perpendicular to the front surface 2, as indicated by the arrow. As such, the audio output travels towards listeners, who are typically seated in front of the TV and the sound bar 1. This direction of audio output allows the sound to bounce off walls in the room to provide a listener with a feeling of surround sound.

It would be desirable to provide a sound bar that further enhances a TV viewer's audio experience by providing sound that not only travels toward the viewer (i.e., in a generally horizontal direction away from the sound bar and towards the walls in a room), but that also travels upwards towards the ceiling. This would provide a signal that bounces off walls of a room as well as off the ceiling, thus, making the sound more realistic. It would be highly desirable to further provide for 3D sound audio processing which will give a listener the added sensation of height speakers for a more realistic sound.

A sound bar 10 having both front directed (i.e., generally horizontal) and upward directed (i.e., generally vertical) audio output has recently been proposed, wherein a plurality of speakers 16 are provided on both a front surface 12 and a top surface 15, as shown in FIG. 2. However, this design can be bulky when mounted on a wall or when positioned on a table or shelf. In particular, when mounted on a table or shelf, the bottom surface 13 must have a large enough area so that the device is stably positioned. Also, the bottom surface 13 is opposite the top surface 15, which has a plurality of speakers 16 disposed therein. Thus, the top surface 15 must be adequately sized to house the speakers 16—and, as a result, the opposing bottom surface 13 is equally large. Similarly, the back surface 14 must be large enough so that the device can be stably mounted on the wall. In addition, the front surface 12 must be adequately sized to house the speakers 16—and, as a result, the opposing back surface 14 is equally large. Further, this type of sound bar 10 design has the added drawback in that when it is mounted on a table or shelf below a TV or on the wall below a TV, the audio output from the top surface 15 speakers 16 can be partially blocked and muffled by the TV and/or any additional shelving disposed above the sound bar 10.

Flat sound bars 20, such as those shown in FIGS. 3A-3B have been designed to provide a user with a sleeker look. An example of a horizontal (e.g., table) mounted flat sound bar 20 is shown in FIG. 3A, with the bottom surface 23 being mounted on the horizontal surface. Because of the narrow thickness, this design is conducive to speaker 26 placement on the top surface 25 only. This results in audio output from the sound bar 20 in an upwards direction toward the ceiling and not toward a listener. However, when this sound bar 20 is mounted on a table or shelf below a TV, the audio output from the top surface 25 speakers 16 can be partially blocked and muffled by the TV and/or any additional shelving disposed above the sound bar 20. An example of a vertical (e.g., wall) mounted flat sound bar 20 is shown in FIG. 3B. In this configuration, the speakers 16 are disposed in the front surface 22, and the back surface 24 is mounted on a wall. This provides the generally desired audio output toward a listener and the walls in a room (i.e., generally horizontal). However, with such a flat sound bar 20 design, regardless of mounting style, it is not possible to dispose speakers in both a forward and upward facing direction of a single sound bar 20 to provide improved audio output given the narrow thickness of the structure.

It would be desirable to provide an improved sound bar design that could be mounted on either a table/shelf or on a wall, and which provides audio output in multiple directions. It would further be desirable to provide such a sound bar design that is 3D sound capable.

SUMMARY OF INVENTION

According to one aspect, the present invention provides a sound bar comprising an elongate housing having a front surface, a back surface, a bottom mounting surface, a top surface, and an output surface connecting and extending at an angle between the front surface and top surface; a plurality of speakers disposed in the output surface; and an audio processor configured for receiving audio information, including information for one or more height channels, processing the received audio information, and providing a 3D audio output. According to this aspect, when the bottom mounting surface of the sound bar is disposed along a horizontal surface, the output surface is angled towards both a forward direction and an upward direction so as to provide multi-directional 3D audio output from the plurality of speakers, and when the bottom mounting surface of the sound bar is disposed along a vertical surface, the output surface is angled towards both a forward direction and an upward direction so as to provide multi-directional 3D audio output from the plurality of speakers.

According to embodiments of this aspect, one or more of the following additional features may be provided. The output surface is at an angle greater than 0° and less than 90° relative to the bottom surface, the angle is between about 10° and about 80°, the angle is greater than about 20°, the angle is greater than about 25°, the angle is greater than about 30°, the angle is greater than about 35°, the angle is greater than about 40°, and in some embodiments, the angle is about 45°. The sound bar further comprises at least a left channel, a right channel, and a height channel, and an orientation detecting device, wherein the orientation detection device is configured and arranged to detect if the orientation of the sound bar changes. In particular, the sound bar can be provided with a sensor such that the orientation recognition feature informs on an orientation change of the sensor with respect to the gravitational field vector 'g.' The measured acceleration vector components with respect to the gravitation field are defined and shown in FIG. 7. As such, the magnitudes of the acceleration vectors can be defined in the following orientations: Portrait Upright, Portrait Upside Down, Landscape Left, and Landscape Right.

According to embodiments of the invention, the orientation detection device is configured and arranged to detect if the bottom mounting surface has changed from an orientation disposed along a vertical surface to an orientation disposed along a horizontal surface and vice versa. If the orientation detection device detects that an orientation of the sound bar has changed, the left and the right channel and the height channel are reconfigured automatically as needed. The sound bar further comprises a user interface in connection with the sound bar, wherein if the orientation detection device detects that an orientation of the sound bar has changed, the sound bar sends a message to the user interface to guide a user through the steps of reconfiguring the left channel, the right channel, and the height channel as needed. Each of the back surface, the front surface, the bottom mounting surface, the top surface, and the output surface have an elongate rectangular shape.

According to another aspect, the present invention provides a sound bar comprising a multi-surface housing having a generally elongate shape, the multi-surface housing having a single mounting surface and an output surface disposed at an angle relative to the single mounting surface; a plurality of speakers disposed in the output surface; and an audio processor configured for receiving audio information, including information for one or more height channels, processing the received audio information, and providing a 3D audio output. According to this aspect, when the single mounting surface is disposed along a horizontal surface, the output surface is positioned such that the plurality of speakers in the output surface deliver multi-directional 3D audio output, and when the single mounting surface is disposed along a vertical surface, the output surface is positioned such that the plurality of speakers in the output surface deliver multi-directional 3D audio output.

According to another aspect, the present invention provides a sound bar comprising a multi-surface housing having a generally elongate shape, the multi-surface housing having a single mounting surface and an output surface disposed at an angle relative to the single mounting surface; a plurality of speakers disposed in the output surface; and an audio processor configured for receiving audio information, including information for one or more height channels, processing the received audio information, and providing a 3D audio output. According to this aspect, when the sound bar is mounted on a horizontal surface and on a vertical surface with the single mounting surface extending along the horizontal or vertical surface, the plurality of speakers in the output surface deliver multi-directional 3D audio output, and the sound bar is switchable from mounting on a horizontal surface and a vertical surface via the single mounting surface by rotating the sound bar 180°.

According to another aspect, the present invention provides a sound bar for delivering a multi-directional audio output comprising a single mounting surface; a single output surface having a plurality of speakers disposed therein; and an audio processor configured for receiving audio information, including information for one or more height channels, processing the received audio information, and providing a 3D audio output. According to this aspect, the output surface is disposed at an angle relative to the single mounting surface, the angle being greater than 0° and less than 90°, when the sound bar is mounted on a horizontal surface with the single mounting surface extending along the horizontal surface, multi-directional 3D audio output is provided, and when the sound bar is mounted on a vertical surface with the single mounting surface extending along the vertical surface, multi-directional 3D audio output is provided.

According to embodiments of this aspect, one or more of the following additional features may be provided. The angle ranges between about 10° and 80°, the angle ranges between about 30° and 60°, and in some embodiments, the angle is about 45°.

Other aspects, embodiments and advantages of the present invention will become readily apparent to those skilled in the art are discussed below. As will be realized, the present invention is capable of other and different embodiments without departing from the present invention. Thus the following description as well as any drawings appended hereto shall be regarded as being illustrative in nature and not restrictive.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principals of the invention. The components in the drawings are not necessarily to scale, emphasis instead being placed upon clearly illustrating the principles of the present invention. In the drawings, each like component is referenced by a like numeral. For purposes of clarity, every component may not be labeled in every drawing. In the drawings:

FIGS. 3A-3B show a conventional flat sound bar design, wherein FIG. 3A is table mounted and provides upward facing speakers, and FIG. 3B is wall mounted and provides front facing speakers.

DETAILED DESCRIPTION OF THE INVENTION

Figure 4A:
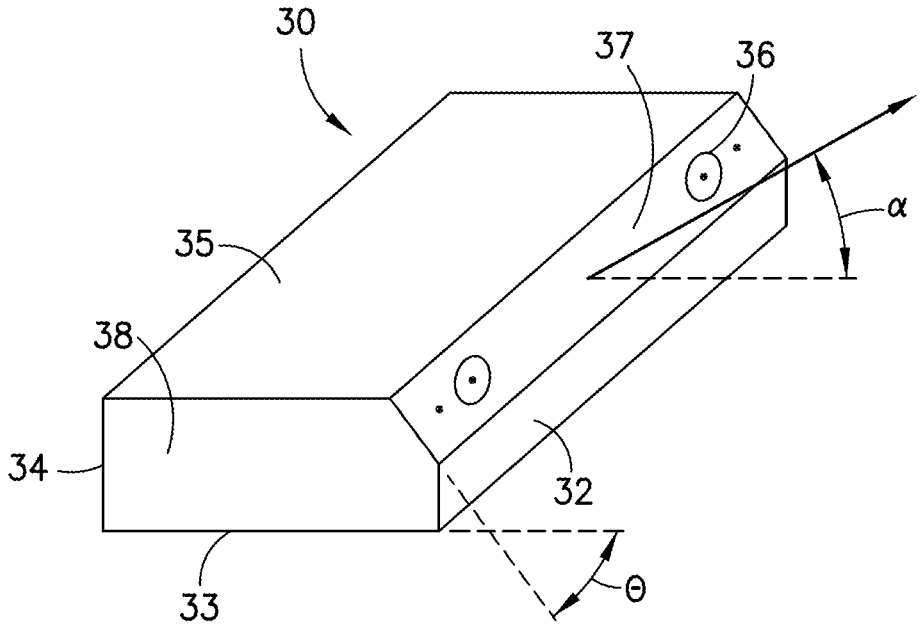
FIGS. 4A-4B shows a schematic diagram of a sound bar design in accordance with an embodiment of the present invention, in which speakers are provided in an audio output surface disposed at an upward angle relative to the listener, with FIG. 4A illustrating the sound bar table mounted, and FIG. 4B illustrating the same sound bar rotated 180° and wall mounted.
Figure 4B:
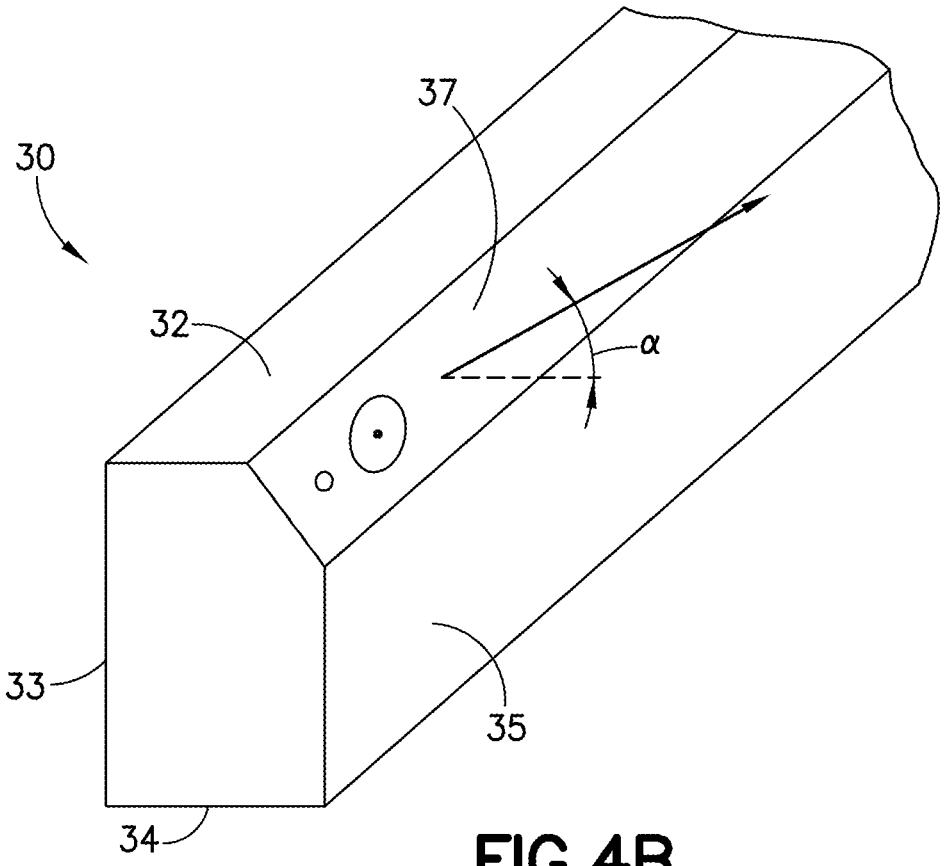

Referring now to the various figures of the drawing wherein like reference characters refer to like parts, there is shown in FIGS. 4A-4B, one example of a sound bar 30 having multi-directional 3D audio output.

As used herein, "multi-directional" sound output or audio output refers to output from a sound bar 30 that travels both towards the walls of a room and towards the ceiling of the room. As such, the audio output travels through the room and bounces off both the walls and ceiling of the room to provide more realistic sound, much like a surround sound system. In addition, multi-directional "3D" audio output refers to such multi-directional output in which the audio output has been audio processed so as to give a listener the sensation that speakers are positioned in a plurality of directions (not just front and back), including above a listener ("height speakers"), even though they are not. As such, with 3D sound, the audio appears to move around and come at the listener from all directions.

More particularly, 3D audio processing manipulates the sound produced by two or more speakers. This may involve the virtual placement of sound sources anywhere in three-dimensional space, including behind, above or below the listener.

3D audio processing may employ a spatial domain convolution of sound waves using head-related transfer functions (HRTF). The processing may transform sound waves using HRTF filters and cross talk cancellation techniques to mimic natural sounds waves, which emanate from a point in a 3D space. The processing manipulates the channels of an audio program using, for example, amplitude manipulation, time delay or echo simulation and/or phase manipulation/canceling techniques in one or more frequency bands to convince the brain of the listener using the ears and auditory nerves, pretending to place different sounds in different 3D locations upon hearing the sounds, even though the sounds may just be produced from just 2 speakers (dissimilar to surround sound).

A transfer function is a function that depicts the relationship between an input and the output of a system. It is a fractional representation with the denominator not equal to 1, if there's feedback in the system. If the transfer function, for example a Z-transform, is localized to the unit circle (or bi-unit circle or tri-unit circle for 2D and 3D cases respectively), it then becomes a Multidimensional Fourier Transform or the frequency response of the system.

The processing may incorporate panorama parameters, processing the relative volume level in each speaker simulates left-right placement. Adding reverb (delayed versions of the signal with some selected frequency band filtering (equalization)) simulates longer distance from the listener. Phase shifting and pitch shifting can simulate movement of an object, for example the Doppler effect. The pitch of an approaching object may be raised, The pitch of a receding object may be lowered. Relative phase shifting and/or phase cancellation across different speakers can simulate movement of objects. Equalization may also provide dimensional qualities, for example, bandpass or low pass filtering of more distant audio sources may provide the illusion of audible diffusion, enhancing the illusion of distance.

The processing may use head-related transfer functions and reverberation, simulating changes of sound on its way from the to the listener's ear. These effects include localization of sound sources behind, above and below the listener. The processing incorporates the positioning and angular disposition of the speakers to leverage reflections to enhance the 3D effect.

According to an exemplary embodiment, the source can be powered 3D audio processing software which contains the required information for height channels. The present sound bar is then configured to take the height information, process it, and provide an audio output such that listener will have the sensation there are speakers installed above (as well as all around) even though there aren't any in those positions. In particular, the present sound bar provides sound that travels to the walls and ceiling so that the sound bounces off the walls and ceiling. By providing sound that bounces off the ceiling, in particular, height information is provided by the present sound bar which is either wall or table/counter mounted. This eliminates the need to provide speakers in the ceiling.

It is noted that as a result of the difference in orientation (i.e., whether mounted on a horizontal or vertical surface)

made possible by the present sound bar 30, it should be noted that the terms such as top, bottom, front and back for example, are relative terms used to demonstrate location/position of surfaces of the sound bar 30, relative to each other, with reference to the resting on a horizontal surface. Of course, changing position, or orientation of the sound bar 30 to vertical would change the bottom surface 33 from being located on "the bottom", however, relative location of surfaces of the sound bar 30 are maintained. As shown in FIGS. 4A-B, the sound bar 30 is provided with a generally elongate structure including a top surface 35, bottom surface 33, front surface 32, and back surface 34. In addition, an output surface 37 is provided at an angle extending between the top surface 35 and the front surface 32. A plurality of speakers 36 are disposed in the angled output surface 37 so as to deliver multi-directional audio output. The plurality of speakers 36 are positioned in the angled output surface 37 in such a way as to provide a surround sound effect by directing the audio output towards both the walls and ceiling of a room so as to make the sound bounce off the walls and the ceiling. The number of speakers 36 can vary based on the desired effect, and for example, as with typical sound bars, may contain two to five (or even more) speakers 36.

According to a preferred embodiment, the sound bar 30 is configured such that the bottom surface 33 forms a single surface for mounting the sound bar 30 either on a vertical surface (e.g., a wall) or on a horizontal surface (e.g., a table or shelf). In particular, the sound bar 30 is shown in FIG. 4A as it would be mounted on a table/shelf with the bottom surface 33 being mounted on a table/shelf. In order to switch to a wall mounted configuration, all that one would need to do is rotate the sound bar 30 so that the bottom surface 33 is mounted along a wall.

In general, the sound bar 30 of the present invention is configured such that when the mounting surface 33 is disposed on both a horizontal surface (e.g., table/shelf) and on a vertical surface (e.g., wall), the output surface 37 is disposed at an angle relative to the walls and ceiling of a room so that the audio output from the output surface 37 is multi-directional in both mounting positions.

Figure 1:
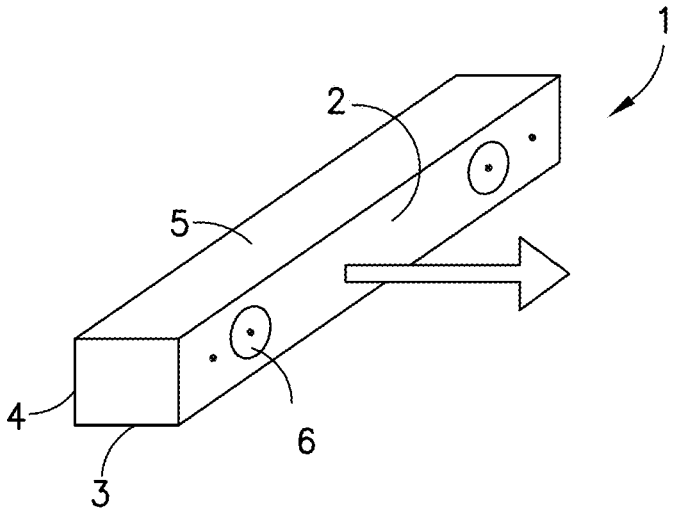
FIG. 1 PRIOR ART
FIG. 1 shows a conventional front facing sound bar design.
Figure 2:
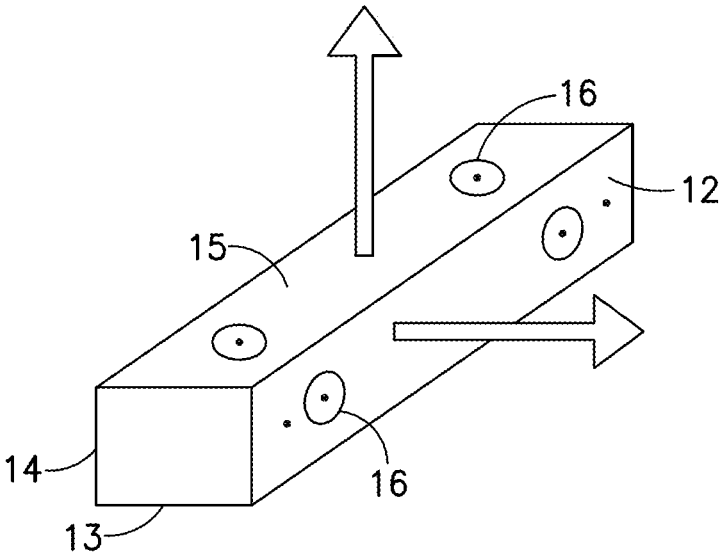
FIG. 2 PRIOR ART
FIG. 2 shows a conventional sound bar design concept which includes both front facing speakers and upward facing speakers.
Figure 3A:
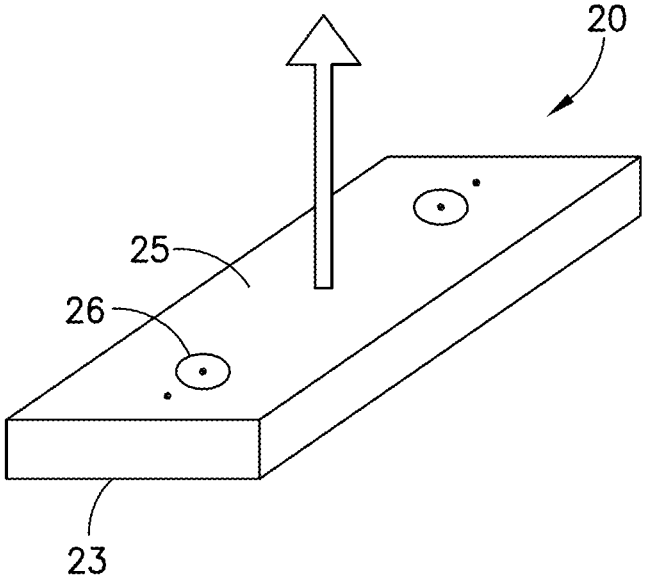
FIG.3A PRIOR ART
Figure 3B:
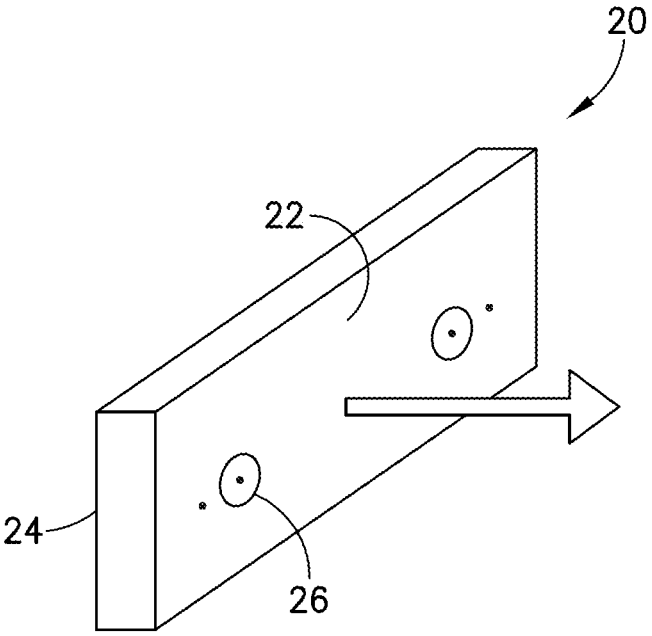
FIG.3B PRIOR ART

According to embodiments of the invention, the angle of audio output is selected from any angle other than (1) directly perpendicular to the walls (a directly forward output/"horizontal" output, such as that shown in FIG. 1, with the output surface 37 being parallel to the walls and perpendicular to the ceiling) and (2) directly parallel to the walls (a directly upward output/"vertical" output, such as that shown in FIG. 3A, with the output surface 37 being perpendicular to the walls and parallel to the ceiling).

In particular, the angle of the output surface 37 is an upward facing angle, and the corresponding angle of audio output is upwardly angled. The angle of audio output should be angled enough away from the walls to provide audio output that travels to and bounces off both the walls and the ceiling of a room in which the sound bar 30 is disposed.

According to one exemplary embodiment, the output surface has about a 45° upward facing configuration. In particular, the output surface 37 is at an angle $\theta$ of about 45° relative to the bottom surface 33. This results in an audio output angle $\alpha$ (relative to a directly forward output, "horizontal" output) of about 45°. With a 45° output angle, the output angle is the same for both the table/shelf mounted configuration and the wall mounted configuration. Of course, the present invention is not limited to only a 45° upward facing configuration and output angle. Rather, the audio output angle $\alpha$ can range between an amount greater than 0° and less than 90°, and preferably ranges between about 10° and about 80°. According to some embodiments, the audio output angle $\alpha$ is at least about 5°, more preferably at least about 10°, more preferably at least about 15°, more preferably at least about 20°, more preferably at least about 25°, more preferably at least about 30°, more preferably at least about 35°, or more preferably at least about 35°. According to some embodiments, the audio output angle $\alpha$ is less than about 80°, more preferably less than about 75°, more preferably less than about 70°, more preferably less than about 65°, more preferably less than about 60°, more preferably less than about 55°, or more preferably less than about 50°.

It is to be noted that some of the angles on either end of the range (i.e., closer to 0° and) 90°, while possibly providing multi-directional audio output, may not be as effective in providing adequate multi-directional audio output that travels to and bounces off both the walls and ceiling as desired. Also, one skilled in the art would understand that the configuration of each individual room—e.g., the location, sizing, and configuration of the various walls, as well as the sizing, height, and configuration of the ceiling(s) in a room—will have an impact on the audio output angle that would be functional or optimal. For example, in a larger room with a high ceiling and walls that are spaced at a greater distance from the mounted sound bar 30, the audio output would travel a greater distance before hitting the walls and ceiling. Thus, sound traveling at a smaller angle will have a greater opportunity to travel upwards and eventually hit and bounce off a ceiling in addition to the walls. On the other hand, in a smaller room with a shorter ceiling and walls spaced closer to the mounted sound bar, audio output at a smaller angle may not necessarily hit and bounce off a ceiling in addition to the walls, or may not do so to a great enough extent. Thus, the room configuration can be taken into consideration in designing a sound bar with a desired audio output angle.

According to the embodiment shown, the sound bar 30 is in the form of a polyhedron with each of the front surface 32, bottom surface 33, back surface 34, top surface 35, and output surface 37 having elongate rectangular shapes, and a left side 38 and right side 39 each having a shape of a pentagon with three right angles. This, of course, is a specific structure, and modifications are possible as long as the sound bar 30 is provided with the bottom surface 33 forming a single surface for mounting the sound bar 30 and the output surface 37 extends at an angle as described above. For example, the bottom surface 33 and top surface 35 could both be in the form of trapezoids, for example isosceles trapezoids, thus providing a sound bar that is larger in the front and tapers towards the back.

As shown in FIGS. 4A-B, in order to change mounting options between horizontal and vertical, the sound bar 30 can simply be rotated 180° when viewing the sound bar 30 from the front surface 32. In addition, in order for the sound bar 30 to provide proper audio output in either mounting option, the sound bar channels (e.g., left and right channels, as well as height channels, which will swap positions when the sound bar 30 is changed between a horizontal and a vertical mount according to the present sound bar configuration) will need to be modified depending on their orientation. According to some embodiments, a user interface that is used to control the sound bar 30 (which may be the same user interface used to control the TV or may be separate) provides a user with the ability to proactively switch channels if the user changes the mounting orientation of the sound bar 30. For example, the user interface may include a series of prompts which the user can respond to so as to ensure that the channel orientation matches the mounting position of the sound bar 30. According to some embodiments, the sound bar 30 includes an accelerometer, switch, or other known device disposed therein to detect changes in orientation of the sound bar 30. The accelerometer can be provided in communication with the user interface such that when a change in orientation of the sound bar 30 is detected, the user receives a prompt on the user interface that requires that the user go through the process of identifying the sound bar 30 orientation and selecting the appropriate channel orientation.

Alternatively, the accelerometer can be provided in communication with a channel configuration mechanism or control such that when a change in orientation of the sound bar 30 is detected by the accelerometer, the orientation is automatically determined and the appropriate channel orientation is automatically determined and changed as required. In addition to the need to ensure proper channel positioning depending on mounting position, equalization of the sound bar 30 may also need to be changed upon a change in sound bar orientation to optimize the audio output depending upon the mounting position. As such, the above-noted possibilities for checking and changing channel orientation depending upon a change in mounting orientation may also be provided for changing equalization settings.

General features regarding the internal electronics of the sound bar 30 and how it interacts with the TV to provide audio output can be in accordance with conventional sound bars. For example, the sound bar 30 can be connected to the TV via an HDMI cable, and can be further provided with one or more optical or coaxial digital audio input and stereo RCA inputs. In some embodiments, the sound bar 30 includes wireless technology, such as Bluetooth or WiFi, for pairing with smart phones and tablets. The sound bar 30 may be operable using a remote control, or it can be connected to a phone or tablet using a downloadable app that allows the user to control the sound bar with the phone or tablet. According to some embodiments, the sound bar 30 is provided with drivers that angle outward toward the sides of a room in which the sound bar 30 is located, so as to provide an even broader field of sound. The sound bar 30 may come with a wired or wireless subwoofer to provide 2.1 channels (the sound bar containing two speakers, such as a left and a right, with the separate subwoofer). Alternatively, to provide more realistic surround sound, the sound bar 30 can be used together with additional speakers (e.g., a subwoofer, rear speakers, and/or side speaker) to provide multichannel sound.

In accordance with another alternative embodiment of the invention, one or more surface of the sound bar 30 may be convex in shape. As a result, instead of being flat, the output surface may instead be convex, as long as the audio output angle ranges between greater than 0° and less than 90°. In other alternative embodiments, the front surface and top surface may also be convex.

Figure 5:
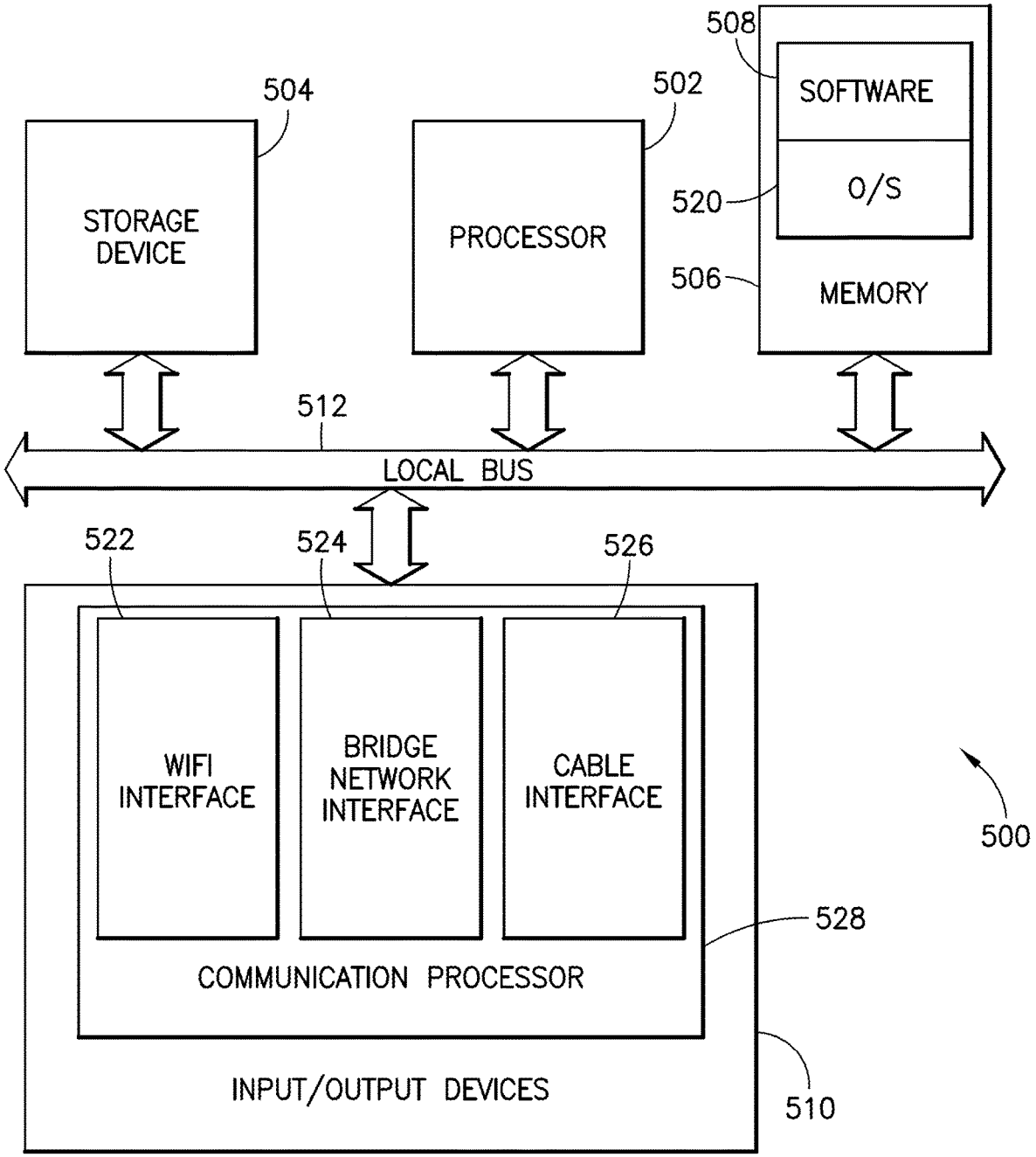
FIG. 5 is a schematic diagram illustrating an example of a system for executing functionality of the present invention.

As previously mentioned, the present system for executing the functionality described in detail above may be a computer, an example of which is shown in the schematic diagram of FIG. 5. The system 500 contains a processor 502, a storage device 504, a memory 506 having software 508 stored therein that defines the abovementioned functionality, input and output (I/O) devices 510 (or peripherals), and a local bus, or local interface 512 allowing for communication within the system 500. The local interface 512 can be, for example but not limited to, one or more buses or other wired or wireless connections, as is known in the art. The local interface 512 may have additional elements, which are omitted for simplicity, such as controllers, buffers (caches), drivers, repeaters, and receivers, to enable communications. Further, the local interface 512 may include address, control, and/or data connections to enable appropriate communications among the aforementioned components.

The processor 502 is a hardware device for executing software, particularly that stored in the memory 506. The processor 502 can be any custom made or commercially available single core or multi-core processor, a central processing unit (CPU), an auxiliary processor among several processors associated with the present system 500, a semiconductor based microprocessor (in the form of a microchip or chip set), a macroprocessor, or generally any device for executing software instructions.

The memory 506 can include any one or combination of volatile memory elements (e.g., random access memory (RAM, such as DRAM, SRAM, SDRAM, etc.)) and non-volatile memory elements (e.g., ROM, hard drive, tape, CDROM, etc.). Moreover, the memory 506 may incorporate electronic, magnetic, optical, and/or other types of storage media. Note that the memory 506 can have a distributed architecture, where various components are situated remotely from one another, but can be accessed by the processor 502.

The software 508 defines functionality performed by the system 500, in accordance with the present invention. The software 508 in the memory 506 may include one or more separate programs, each of which contains an ordered listing of executable instructions for implementing logical functions of the system 500, as described below. The memory 506 may contain an operating system (O/S) 520. The operating system essentially controls the execution of programs within the system 500 and provides scheduling, input-output control, file and data management, memory management, and communication control and related services.

The I/O devices 510 may include input devices, for example but not limited to, a keyboard, mouse, scanner, microphone, etc. Furthermore, the I/O devices 510 may also include output devices, for example but not limited to, a printer, display, etc. Finally, the I/O devices 510 may further include devices that communicate via both inputs and outputs, for instance but not limited to, a modulator/demodulator (modem; for accessing another device, system, or network), a radio frequency (RF) or other transceiver, a telephonic interface, a bridge, a router, or other device. When the system 500 is in operation, the processor 502 is configured to execute the software 508 stored within the memory 506, to communicate data to and from the memory 506, and to generally control operations of the system 500 pursuant to the software 508, as explained above.

Figure 6:
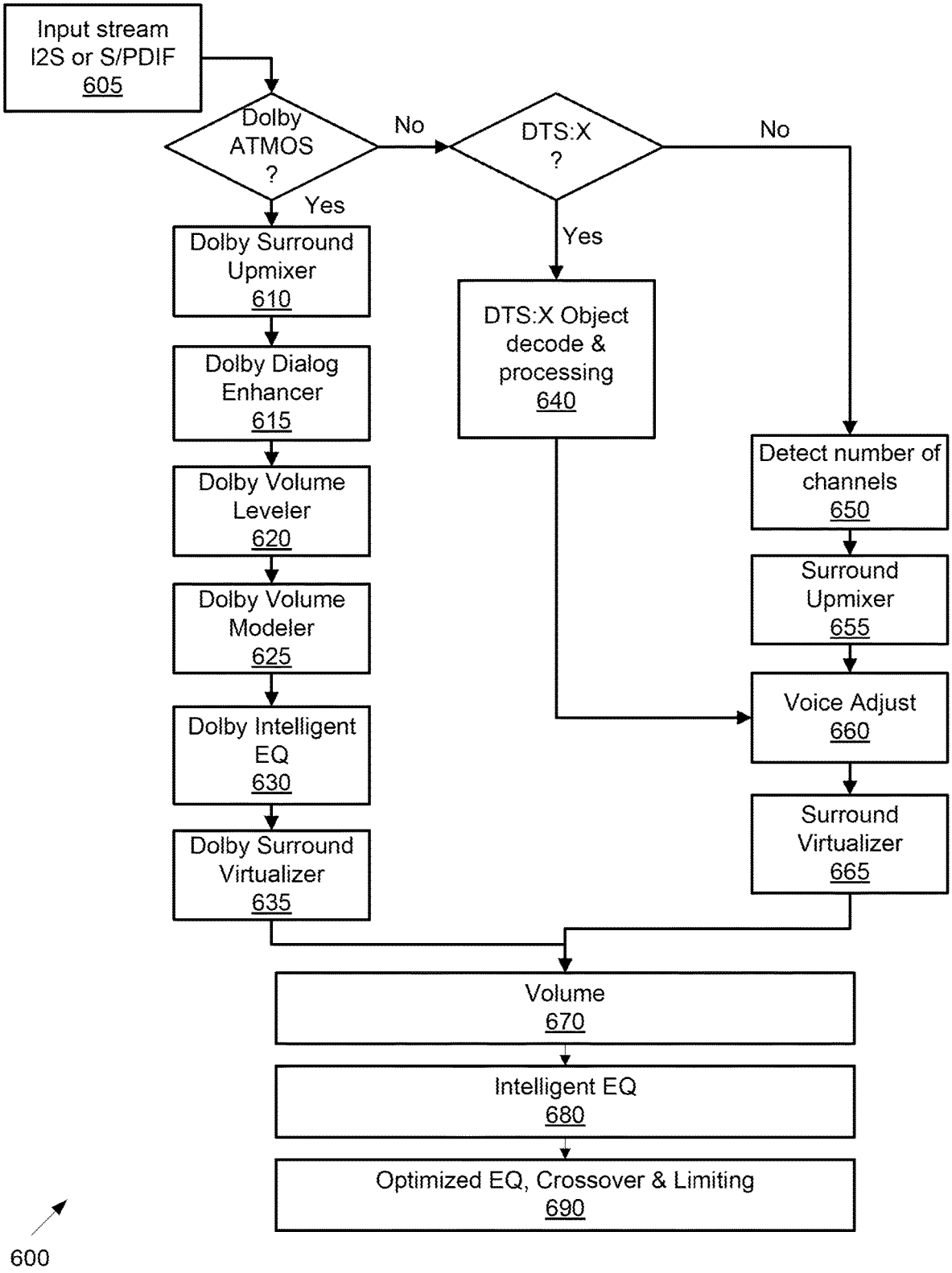
FIG. 6 is a block diagram of an exemplary 3D audio imaging system for the sound bar indicating the different types of processing of the audio signal in view of the audio encoding protocol.
Figure 7:
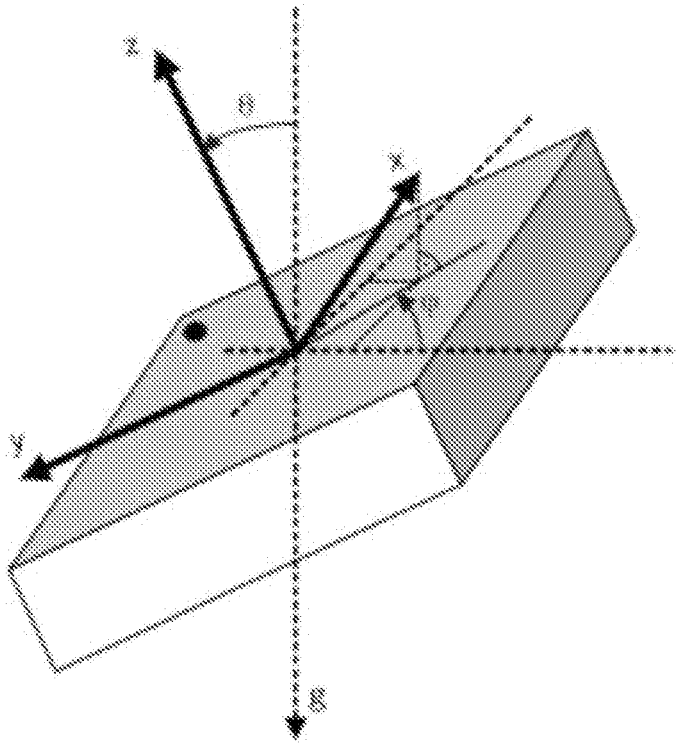
FIG. 7 is a schematic diagram illustrating an embodiment of an orientation recognition feature of the sound bar in which acceleration vector components are measured and shown with respect to the gravitational field vector.

As shown by FIG. 6, in general, the 3D image processing of the audio signal produced by the sound bar 30 may be handled by a 3D audio imaging system 600 that takes several factors into account, including, for example, the physical configuration of the sound bar 30 in view of the audio encoding protocol. The physical configuration of the speakers may include, for example, the number and type of speakers (e.g., the sound bar 30 and optional additional speakers such as a front stereo pair, center speaker, rear speakers, side speakers, subwoofer), the orientation of each of the speakers, and the dimensions of the sound bar 30, among others.

The physical configuration of the speakers may be stored, for example, in a configuration file, which may be determined in a number of ways. For example, the types of speakers may be entered into a configuration application that may access a database of speaker types (make, model, etc.).

The configuration application may display icons representing each of the speakers on a display that allows a user to place the icons in the display according to their physical locations. This configuration application may take into account other physical attributes of the listening space that may affect 3D imaging, such as the physical dimensions of the room, placement of furniture, the type of flooring, among other attributes. The configuration application may also gather information regarding reflection and absorption attributes of the room across the audible frequency spectrum, for example, by using microphones to record how the listening space affects test audio signals played through one or more of the speakers.

The type of 3D processing may be different depending upon the audio encoding protocol being used, for example, Dolby ProLogic, DTS NEO, SRS, or DTS Neural X. As shown by block 605, the 3D audio imaging system 600 receives an input stream of audio, for example, I2S (Inter-IC Sound) or S/PDIF (Sony/Philips Digital Interface). If the input stream is detected as being Dolby ATMOS surround sound technology, the processing proceeds through blocks 610-635. If the input stream is detected as being DTS:X, the processing proceeds through block 640. If the input stream is neither Dolby ATMOS nor DTS:X, the processing proceeds through blocks 650-665.

In the case of Dolby Atmos, the signal is processed by a Dolby Surround Upmixer (block 610), a Dolby Dialog Enhancer (block 615), a Dolby Volume Leveler (block 620), a Dolby Volume Modeler (block 625), a Dolby Intelligent Equalizer (EQ) (block 630) and a Dolby Surround Virtualizer (block 635), before being processed for volume by block 670.

In the case of neither Dolby or DTS:X, the audio imaging system 600 detects the number of audio channels in the input stream, as shown by block 650, and is processed by a surround upmixer, as shown by block 655. A voice adjust module is used to enhance the intelligibility of a spoken voice, for example, movie dialog or announcer dialog over other audio content, as shown by block 660. As shown by block 665, a Surround Virtualizer module widens the image of information that would normally be reproduced in the rear surround speaker in a traditional surround sound system and the image may be then presented to the far left and right depending on how strong original content was steer left or right. It does not affect any dialog dedicated for center imaging. The Surround Virtualizer optimizes for the 45-degree angle of the drivers of the sound bar 30 to allow improved acoustic presentation of the audio regardless of the mounting orientation of the sound bar 30, such as mounting the sound bar 30 on a wall or a table. The frequency weighting processing is applied to sound bar 30 drivers in a 45-degree orientation differently than in a fixed vertical position. The frequency weighting and sample gain is calculated per sample in real time with no look ahead buffering. As a result, latency is minimized based on an optimization of the algorithm to widen the sonic image and to achieve an effect similar to mounting the drivers in a perfect vertical position.

For the DTS:X path, the audio is processed by an object decode and processing module, as shown by block 640. The output of the object decode and processing module is routed to the voice adjust block 660 and thereafter to the surround virtualizer 665, as described above, before being fed to the volume block 670.

For each of the paths, after the volume block 670, an Intelligent Equalizer module, as shown by block 680, provides bass enhancement based on dynamically adjusting state variable filter parameters with a lookup table custom tailored for the speaker/enclosure and power available to optimize the bass response dynamically as the music is playing and what the "power" of the signal is based on the volume setting and content itself. An exemplary Intelligent Equalizer is described in U.S. Pat. No. 7,171,010.

As shown by block 690, the audio is processed to optimize equalization, apply crossover frequencies and dynamics limiting. Optimized equalization may include high pass and low pass filters, multi-band compressors, limiters, and parametric equalization and delay. This module is configured to optimize the 3D imaging for the 45-degree angle of the drivers in the sound bar 30 so that the driver angle is optimized regardless of the mounting orientation, such as wall and table mounting.

In an embodiment of the invention, driver orientation optimization is based off of both audio content and driver orientation. In the case of multi-channel content, the surround channel information may be split inside the processor and widened based on the ratio of the difference between a left and right channel. The greater the ratio, the greater the effect of projecting the image of the sound either left or right per digital sample. This ratio is preferably also frequency weighted so that only mid to high frequencies are emphasized with the most prominence so that a given widening effect is controlled based on frequency and ratio of left/right. In the case of two channel content, an up mixing may be applied to generate surround channel audio as discrete five channel output. Mono content is steered to the center image balanced across all drivers. Surround content may also be processed in this way. The driver orientation may further be processed so certain frequency dependent acoustic increases in sound pressure level, based on mounting position and driver angle, are negated based on modeling of the system and a applying a negating transfer function.

The sound bar 30 described in the above embodiments may leverage the geometry of the listening space such that direct and reflected sound waves emanating from the sound bar 30 reach the ears of the listener with characteristics, for example, time/phase delay, that induces the experience of audio imaging such that sources of sounds may appear to originate from locations that may not be associated with the physical location of the transducers/drivers, for example, above and/or below the plane in which the physical audio transducers are located, as well as more distant and/or closer than the transducers. The processing of the 3D audio imaging system 600 further enhances this effect. In particular, the 3D audio imaging system 600 leverages the geometry of the sound bar 30 within the listening space to supplement this effect.

In some embodiments, the 3D audio imaging system 600 may be at least partially implemented by processors located within the sound bar 30 itself. Alternatively, the 3D audio imaging system 600 may be external to the sound bar 30, for example, within an audio distribution amplifier or a surround sound processor or receiver.

In view of the foregoing, it is intended that the present invention cover modifications and variations of this invention provided they fall within the scope of the following claims and their equivalents.

What is claimed is:

1. A sound bar interchangeably mountable to a horizontal surface and to a vertical surface, the sound bar comprising:

an elongate housing having a front surface, a back surface, a bottom mounting surface configured to be interchangeably mountable in a first orientation to the horizontal surface and in a second orientation to the vertical surface, a top surface, and an output surface connecting between the front surface and top surface at an angle with respect to the bottom surface between 10° and 80°;

a plurality of speakers disposed in the output surface; and an audio processor configured for receiving audio information, including information for one or more height channels, processing the received audio information, and providing a 3D audio output for the one or more height channels according to the first orientation or the second orientation, wherein when the bottom mounting surface of the sound bar is disposed along the vertical surface or the horizontal surface, the output surface is angled towards both a forward direction and an upward direction so as to provide multi-directional 3D audio output from the plurality of speakers.

2. The sound bar of claim 1, wherein the angle is greater than about 20°.

3. The sound bar of claim 1, wherein the angle is greater than about 25°.

4. The sound bar of claim 1, wherein the angle is greater than about 30°.

5. The sound bar of claim 1, wherein the angle is greater than about 35°.

6. The sound bar of claim 1, wherein the angle is greater than about 40°.

7. The sound bar of claim 1, wherein the angle is about 45°.

8. The sound bar of claim 1, further comprising at least a left channel, a right channel, and a height channel, and an orientation detecting device, wherein the orientation detection device is configured and arranged to detect if the orientation of the sound bar changes.

9. The sound bar of claim 8, wherein the orientation detection device is configured and arranged to detect if the bottom mounting surface has changed from the first orientation to the second orientation and vice versa.

10. The sound bar of claim 8, wherein if the orientation detection device detects that an orientation of the sound bar has changed, the left and the right channel and the height channel are reconfigured automatically as needed.

11. The sound bar of claim 8, further comprising a user interface in connection with the sound bar, wherein if the orientation detection device detects that an orientation of the sound bar has changed, the sound bar sends a message to the user interface to guide a user through the steps of reconfiguring the left channel, the right channel, and the height channel as needed.

12. The sound bar of claim 1, wherein each of the back surface, the front surface, the bottom mounting surface, the top surface, and the output surface have an elongate rectangular shape.

13. A sound bar interchangeably mountable to a horizontal surface or to a vertical surface, the sound bar comprising:

a multi-surface housing having a generally elongate shape, the multi-surface housing having a single mounting surface configured to be interchangeably mountable in a first orientation to the horizontal surface and in a second orientation to the vertical surface and an output surface disposed at an angle relative to the single mounting surface between 10° and 80°;

a plurality of speakers disposed in the output surface; and an audio processor configured for receiving audio information, including information for one or more height channels, processing the received audio information, and providing a 3D audio output for the one or more height channels according to the first orientation or the second orientation, wherein when the single mounting surface is disposed along the vertical surface or the horizontal surface, the output surface is positioned such that the plurality of speakers in the output surface deliver multi-directional 3D audio output.

14. A sound bar interchangeably mountable to a horizontal surface or to a vertical surface, the sound bar comprising:

a multi-surface housing having a generally elongate shape, the multi-surface housing having a single mounting surface configured to be interchangeably mountable in a first orientation to the horizontal surface and in a second orientation to the vertical surface and an output surface disposed at an angle relative to the single mounting surface between 10° and 80°;

a plurality of speakers disposed in the output surface; and an audio processor configured for receiving audio information, including information for one or more height channels, processing the received audio information, and providing a 3D audio output for the one or more height channels according to the first orientation or the second orientation, wherein when the sound bar is interchangeably mounted on a horizontal surface or on a vertical surface with the single mounting surface extending along the horizontal or vertical surface, the plurality of speakers in the output surface deliver multi-directional 3D audio output, and wherein the sound bar is switchable from mounting in the first orientation and the second orientation by rotating the sound bar.

15. A sound bar for delivering a multi-directional audio output, the sound bar interchangeably mountable to a horizontal surface or to a vertical surface, the sound bar comprising:

a single mounting surface configured to be interchangeably mountable in a first orientation to the horizontal surface and in a second orientation to the vertical surface;

a single output surface having a plurality of speakers disposed therein; and an audio processor configured for receiving audio information, including information for one or more height channels, processing the received audio information, and providing a 3D audio output for the one or more height channels according to the first orientation or the second orientation;

wherein output surface is disposed at an angle relative to the single mounting surface, the angle being greater than 10° and less than 80°, wherein when the sound bar is mounted in the first orientation or the second orientation, multi-directional 3D audio output is provided.

16. The sound bar of claim 15, wherein the angle ranges between about 10° and 80°.

17. The sound bar of claim 15, wherein the angle ranges between about 30° and 60°.

18. The sound bar of claim 15, wherein the angle is about 45°.

* * * * *